US005222911A

United States Patent [19]

Moji

[11] Patent Number: 5,222,911

[45] Date of Patent: Jun. 29, 1993

[54] POLE HOLDING MEMBER IN CONNECTOR

[75] Inventor: Eiro Moji, 23-35 Shinmeidai 3-chome, Hamura-shi, Tokyo, Japan

[73] Assignee: Eiro Moji, Tokyo, Japan

[21] Appl. No.: 970,392

[22] Filed: Nov. 2, 1992

[30] Foreign Application Priority Data

Nov. 19, 1991 [JP] Japan ..... 3-329952

[51] Int. Cl.[5] ..... H01R 13/514

[52] U.S. Cl. ..... 439/752; 439/724

[58] Field of Search ..... 439/607, 609, 752, 701, 439/708, 712, 718, 749, 724

[56] References Cited

U.S. PATENT DOCUMENTS 4,781,625 11/1988 Yang ..... 439/752 X

*Primary Examiner*—Eugene F. Desmond

*Attorney, Agent, or Firm*—Browdy and Neimark

[57] ABSTRACT

A pole holding member made of synthetic resin comprises a cylindrical main body having a bottom and a core fitted into an inner space of the main body. A pole piece holding hole for holding a contact pin is formed in an outer periphery of the core, and is provided in the form of a fitting groove with a U-shaped section having a lateral cleavage portion opening on the side of the periphery of the core. A bottom wall portion of the main body is provided with the pole piece holding hole through which the contact pin passes. In the pole holding member, it is possible to facilitate an operation process for fitting the contact pin into the pole holding member to hold in a connector referred to as a so-called D-subconnector.

4 Claims, 10 Drawing Sheets

FIG. 6
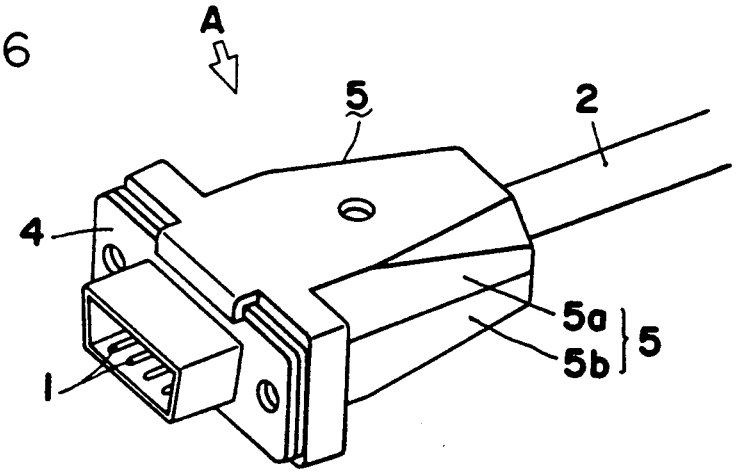
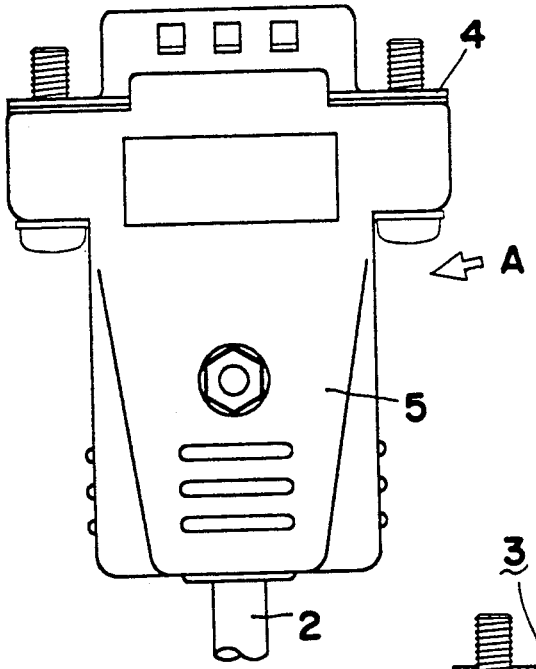
FIG. 9
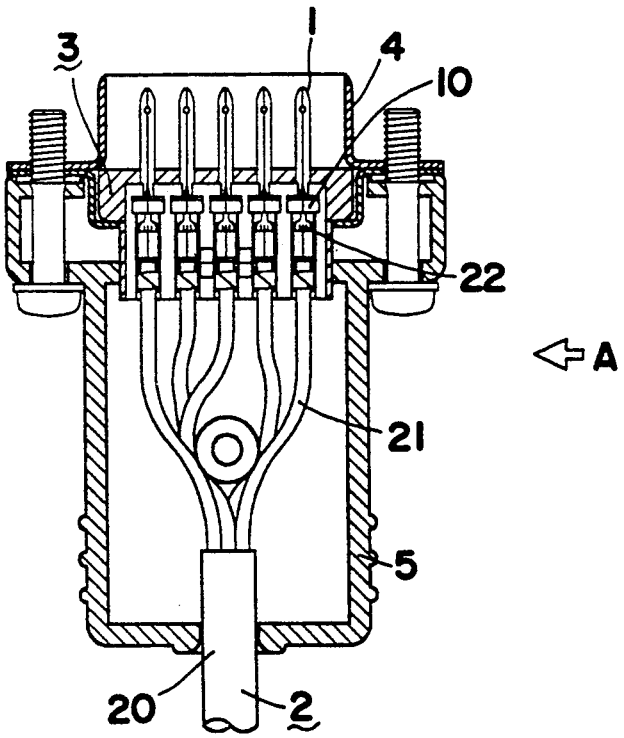
FIG. 10

POLE HOLDING MEMBER IN CONNECTOR

BACKGROUND OF THE INVENTION

1. Field of the Invention

This invention relates to improve a pole holding member to hold a number of pole pieces (contact pins) in a connector referred to as a so-called D-subconnector used for connecting a weak electrical machinery and apparatus.

2. Description of the Prior Art

As shown in FIG. 1, a connector referred to as D-subconnector has a contact pin 1 which is formed by stamping in the form of a cylinder from a high conductive metal plate. FIG. 1 illustrates a male connector. A female connect would be provided with a sheath type contact pin. The contact pin 1 is connected with a metal wire which is a pointed end of each core wire 21 exposed by peeling an outer coating 20 of a cord 2 and is further peeled off an inner coating. In this condition, the contact pin 1 is inserted into a pole holding member 3 comprising a pair of pole holding members 3*a*, 3*b*. The pole holding members 3*a* and 3*b* are made of insulating materials, i.e., synthetic resin, and respectively provided in the forms of a male block and a female block to fit with each other as shown in FIG. 2. Namely, the contact pin 1 is forced into a pole piece holding hole 30 formed in the female rear pole holding member 3*b* until a flange 10 provided for a body of the contact pin 1 comes out of the pole piece holding hole 30. Next, the projecting pointed end of the contact pin 1 is inserted into the corresponding one of the pole piece holding holes 30 formed in the male front pole holding member 3*a*. After completion of the operation, as shown in FIG. 3, the pole holding member 3 is assembled by integrally coupling the male front pole holding member 3*a* and the female rear pole holding member 3*b* with each other. Thus, a number of contact pins 1 are held by the assembled pole holding member 3.

Subsequently, as shown in FIG. 4, the pole holding member 3 is covered with a front shell 4*a* and with a rear shell 4*b*. The pair of shells 4*a*, 4*b* are made of metallic materials in the form of a square cylinder having each joint flange 40 at one end thereof. At the time, the cord 2 passes through the rear shell 4*b* in advance of covering the pole holding member 3. Accordingly, the pole holding member 3 is contained in an internal space which is defined by the front and rear shells 4*a* and 4*b*. In this condition, the respective joint flanges 40 are contacted with each other and integrally coupled by using a spot welding. Thus, the shells 4*a*, 4*b* are assembled as shown in FIG. 5.

Consequently, a connector A is assembled as shown in FIG. 6 by covering the shells 4*a* and 4*b* with an upper and lower cover 5 and integrally assembling the cover 5. The cover 5 comprises a pair of upper cover member 5*a* and lower cover member 5*b* which are made of synthetic resin or metallic materials. The connector A is assembled in the form of a female connector when it has a sheath type contact pin 1 to be assembled.

As set forth hereinbefore, the pole holding member 3 used for the connector A is separately formed as a pair of members to fit with each other. Namely, the holding member 3 comprises the front pole holding member 3*a* which is provided in the form of the male block, and the rear pole holding member 3*b* which is provided in the form of the female block as shown in FIG. 2.

The pin type or sheath type contact pin 1 should be held by the pole holding member 3 so as not to move in the respective pushing and pulling directions. Therefore, the contact pin 1 is inserted into the pole piece holding hole 30 of the rear pole holding member 3*b* from an opening disposed in the back side thereof. Further, the flange 10 mounted on the body of the contact pin 1 passes through and projects from an anchoring claw 31. The anchoring claw 31 has a tongue form, and is provided at an opening in the front side of pole piece holding hole 30 as shown in FIG. 7. Thus, the contact pin 1 can not be moved in the pulling direction. Accordingly, the pointed end of the contact pin 1 is inserted into the pole piece holding hole 30 of the front pole holding member 3*a*. The pole piece holding hole 30 is provided in the sectional form of the contact pin 1 as shown in FIG. 8. As a result, the flange 10 is fixed from the front direction at the rear side of the front pole holding member 3*a* so that the contact pin 1 can not be moved even in the pushing direction. This is the reason why the holding member 3 has the front pole holding member 3*a* and the rear pole holding member 3*b*.

When the conventional pole holding member 3 in the connector A is applied to hold the pin type or sheath type contact pin, the contact pin 1 having an extra fine diameter of 1 to 2 mm should be inserted into the pole piece holding hole 30 of the rear pole holding member 3*b* by using tips of fingers. Further, it is necessary to press the contact pin 1 until the flange 10 mounted on the body of the contact pin 1 passes through and projects from the anchoring claw 31. The anchoring claw 31 is disposed at the opening in the front side of the pole piece holding hole 30 of the rear pole holding member 3*b*. In the pressing operation, if the flange 10 is strongly pressed to pass through the anchoring claw 31 surely, the contact pin 1 may be bent. Thus, it is difficult to control a degree of the pressing operation. On the other hand, once the contact pin 1 has been inserted, it can not be moved in the pulling direction due to engagement of the flange 10 with the anchoring claw 31. If the contact pin 1 is inadvertently bent in the pressing operation, a particular tool is required for pulling the contact pin 1. Therefore, a special attention is essential in the operation for inserting the contact pin 1 into the pole piece holding hole 30 of the pole holding member 3. As a result, the operation becomes complicated.

SUMMARY OF THE INVENTION

In order to overcome the problems set forth hereinbefore, it is an object of the present invention to provide an improved means for fitting a contact pin into a pole holding member to hold only by a simple operation process instead of an operation to press the contact pin in the axial direction thereof.

According to the present invention, the following pole holding member is proposed as a means for achieving the above objects. The pole holding member in a connector is provided with a main body of synthetic resin in the form of cylinder with a bottom, a core fitted into an inner space of the main body. The core includes a pole piece holding hole to hold a contact pin, which is provided in the form of a fitting groove. The pole piece holding hole with a substantially U-shaped section has a lateral cleavage portion opening on the side of an outer periphery of the core. A bottom wall of the main body includes a pole piece holding hole through which a pointed end of the contact pin passes.

BRIEF DESCRIPTION OF THE DRAWINGS

The foregoing and other objects and features of the invention will become apparent from the following description of preferred embodiments of the invention with reference to the accompanying drawings, in which:

FIGS. 1 through 8 illustrate a prior art respectively, in which:

FIG. 1 is a side view of a termination of a cord with a pointed end of a core wire connected to a contact pin, FIG. 2 is a perspective view of a conventional pole holding member, FIG. 3 is a perspective view of the conventional pole holding member with the contact pin held, FIG. 4 is a perspective view illustrating a front shell and a rear shell, FIG. 5 is a perspective view of a connector body assembled by holding the contact pin by the pole holding member, and covering with the shells, FIG. 6 is a perspective view of a connector product assembled by providing the connector body with a cover, FIG. 7 is a vertical side view of a rear pole holding member with the contact pin held, and FIG. 8 is a vertical side view of a front pole holding member;

FIG. 9 is a plan view of a connector according to the present invention;

FIG. 10 is a horizontal plan view of the connector;

DESCRIPTION OF THE PREFERRED EMBODIMENTS

Figure 1:
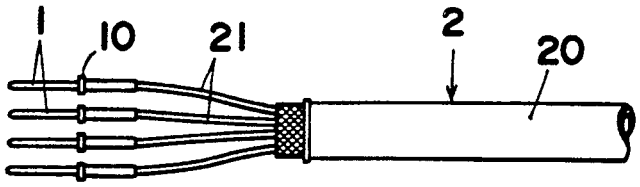
Figure 2:
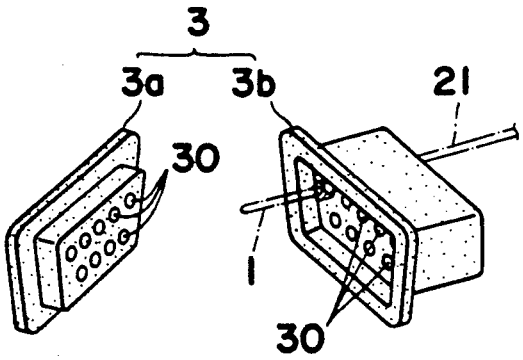
Figure 3:
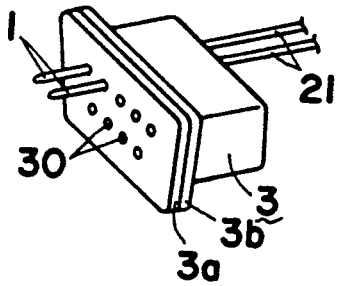
Figure 4:
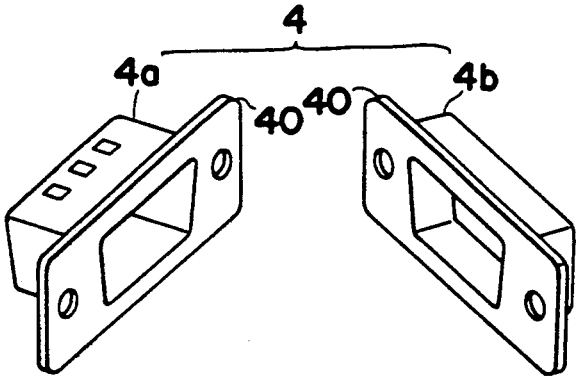
Figure 5:
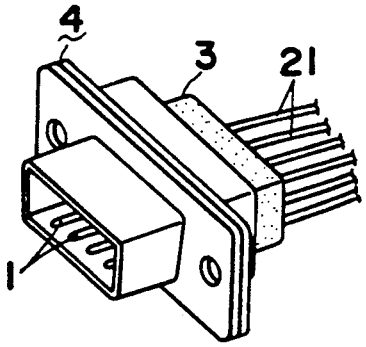
Figure 7:
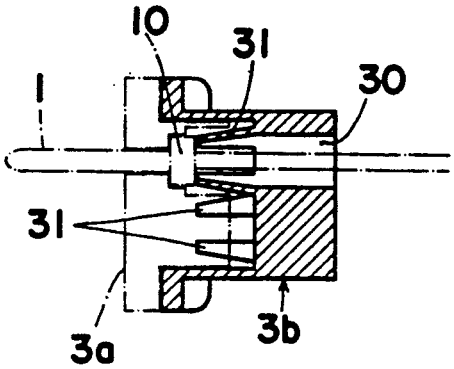
Figure 8:
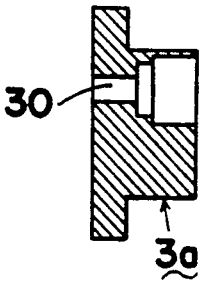

A preferred embodiment will be described with reference to the accompanying drawings. Components in the embodiments will be identified by using the same reference numerals as their corresponding counterparts in the conventional means.

Figure 11:
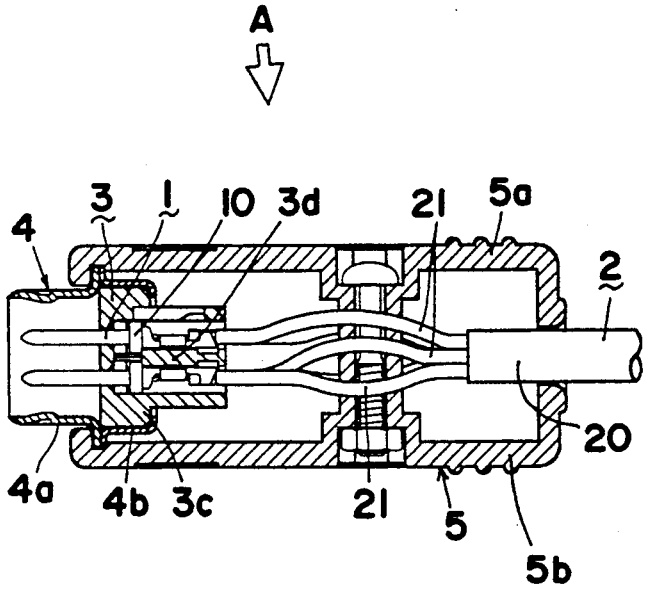
FIG. 11 is a vertical side view of the connector.

FIG. 9 is a plan view of a connector A having a pole holding member according to the present invention. FIG. 10 is a horizontal plan view of the connector A. FIG. 11 is a vertical side view of the connector A. In these drawings, reference numeral 2, 21 and 1 mean a cord, a core wire of the cord and a contact pin connected to a metal wire of the core wire 21, respectively. Other reference numerals 3, 4 and 5 refer to a pole holding member, a shell made of metallic materials, and a cover.

The cord 2 is a typical cord comprising a bundle of a plurality of core wires 21 coated with shielding wires and an outer coatings 20. The core wire 21 is formed by coating the metal wire with an inner coating.

The well-known contact pin 1 is formed by stamping in a predetermined form from a high conductive metal plate and providing the stamped plate with a cylindrical configuration. The contact pin 1 includes a flange 10 having an enlarged diameter, which is mounted on a body at an axial intermediate portion thereof. The core wire 21 is peeled out of the outer coating of the cord 2. A metal wire 22 is peeled out of an inner coating of the core wire 21. The respective terminations of the inner coating of the core wire 21 and of the metal wire 22 are fitted into a cord connecting portion disposed at the back end of the contact pin 1. The respective terminations are further caulked so that the contact pin 1 is mechanically and electrically connected to the terminations of the core wire 21.

Figure 12:
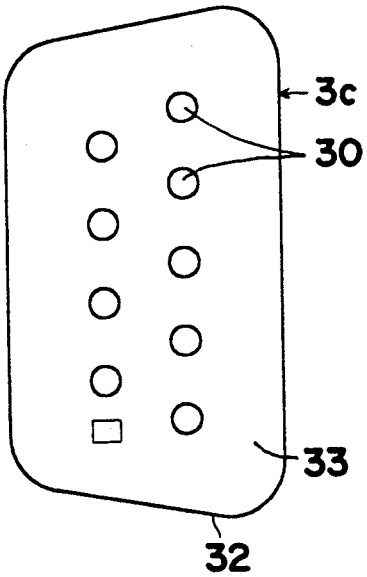
FIG. 12 is a front view of a main body of a pole holding member according to the present invention.
Figure 13:
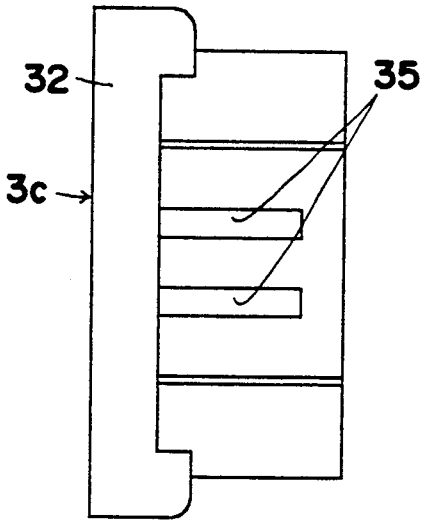
FIG. 13 is a plan view of the main body.
Figure 14:
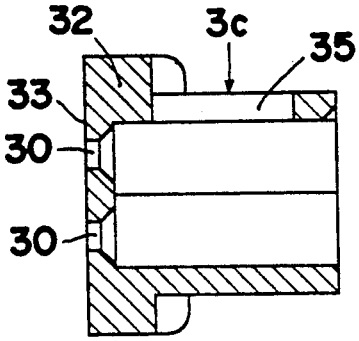
FIG. 14 is a vertical side view of the main body.

The pole holding member 3 is identical with a conventional pole holding member which is made of insulating materials, i.e., synthetic resin. Further, the conventional pole holding member is formed in the block configuration having a pole piece holding hole 30 for holding the contact pin 1 at a predetermined position. Unlike the conventional means, the pole holding member 3 comprises two members, i.e., a cylindrical main body 3*c* with a bottom surface, and a core 3*d*. The main body 3*c* is provided with an engaging flange 32 at one end of an outer periphery thereof as shown in FIGS. 12 to 14. The engaging flange 32 is surrounded with an inner space defined by the shell 4. The core 3*d* is provided in the block form having the pole piece holding hole 30 in an outer periphery thereof as shown in FIGS. 15 to 23. The core 3*d* is further fitted into the inner space of the cylindrical main body 3*c*.

In the cylindrical main body 3*c*, the pole piece holding holes 30 are drilled in an end wall 33 on the front side (on the left-hand side as viewed in FIGS. 13 and 14) serving as a bottom wall portion. The pole piece holding holes 30 are aligned in a predetermined order to hold the contact pin 1 at the predetermined position as shown in FIG. 12. Further, the pole piece holding hole 30 is a circular hole having a small diameter through which the pointed end preceding the flange 10 of the contact pin 1 passes.

The end wall 33 is provided with the engaging flange 32 at a partial outer periphery thereof. The engaging flange 32 serves as an engaging member when the end wall 33 is surrounded with a front shell 4*a* and a rear shell 4*b*.

The main body 3*c* is provided with an engaging groove 35 in an upper wall of a cylindrical portion thereof. The engaging groove 35 is engaged with an engaging projection 34 provided on an outer surface of the core 3*d* when the core 3*d* is fitted into the main body 3*c*. The engaging groove 35 serves to maintain a condition where the core 3*d* and the cylindrical main body 3*c* are integrally coupled with each other. The engaging groove 35 may be provided in a lower wall or right and left side walls as well as in the upper wall. In these cases, the engaging projection 34 is provided for the outer surface of the core 3*d* at a position corresponding to the engaging groove 35. Alternatively, the engaging groove 35 and the engaging projection 34 may be arranged in reverse. Namely, an engaging projection may be provided for the main body 3*c* instead of the engaging groove 35, and an engaging groove may be provided for the outer surface of the core 3*d* instead of the engaging projection 34.

Figure 16:
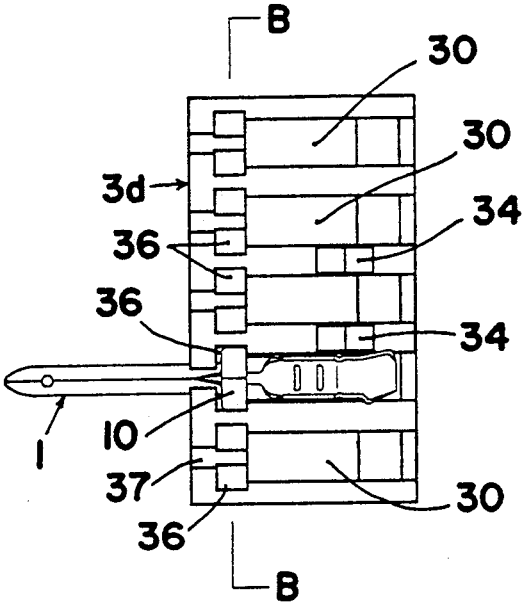
FIG. 16 is a plan view of the core.
Figure 18:
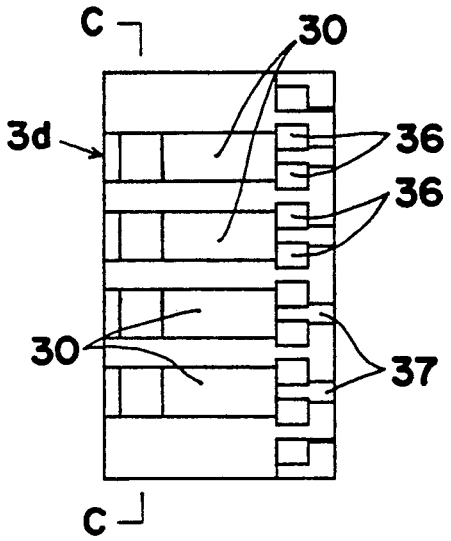
FIG. 18 is a bottom view of the core.
Figure 17:
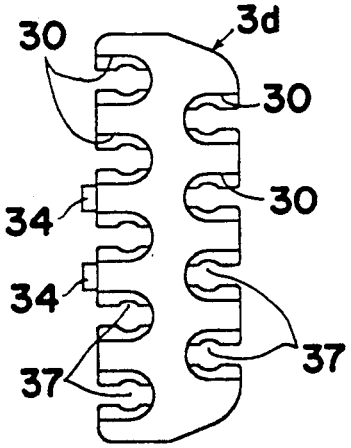
FIG. 17 is a back view of the core.
Figure 21:
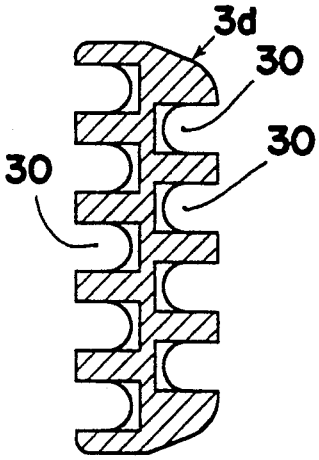
FIG. 21 is a sectional view taken along line C—C of FIG. 18, illustrating the core.
Figure 19:
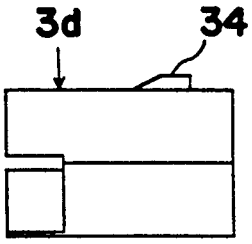
FIG. 19 is a side view of the core.

The core 3*d* is allowed to arrange the pole piece holding holes 30 longitudinally extending (in the right and left directions as viewed in FIGS. 16 and 18) to align in the predetermined order. In the main body, the pole piece holding holes 30 with U-shaped sections open on the side of the outer periphery of the core 3*d* as shown in FIG. 21, and longitudinally extend as shown in FIGS. 16 and 18. Therefore, the pole piece holding holes 30 are provided as grooves with the U-shaped sections. The pole piece holding holes 30 have the cleavage portion successively extending in the outer periphery of the core 3*d*.

Figure 15:
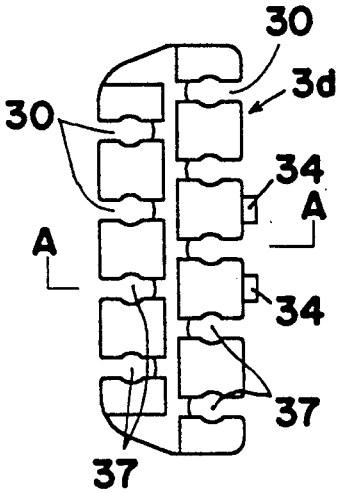
FIG. 15 is a front view of a core of the pole holding member according to the present invention.
Figure 22:
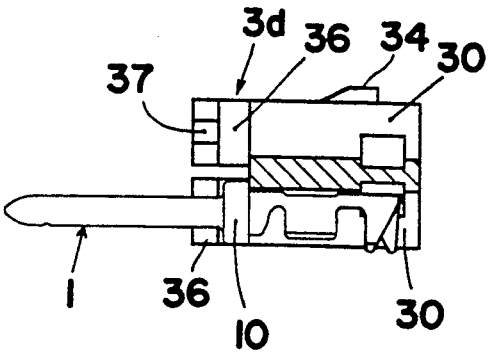
FIG. 22 is a sectional view taken along line A—A of FIG. 15, illustrating the core.
Figure 20:
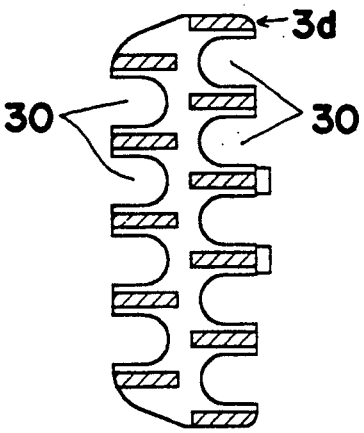
FIG. 20 is a sectional view taken along line B—B of FIG. 16, illustrating the core.

An engaging groove portion 36 is provided for the pole piece holding hole 30 which is formed as a fitting groove with the U-shaped section in the core 3*d*. The engaging groove portion 36 is arranged at a position in the vicinity of the front side of the pole piece holding hole 30 (on the left-hand side as viewed in FIGS. 16 and 17). As shown in FIGS. 16 and 22, the flange 10 of the contact pin 1 passes through an enlarged diameter of the engaging groove portion 36 when the contact pin 1 is fitted in a predetermined condition. Further, the engaging groove portion 36 has a width corresponding to a longitudinal width of the flange 10. As shown in FIGS. 15 and 16, a reduced diameter portion 37 is formed at the front end of the pole piece holding hole 30 preceding the engaging groove portion 36. The reduced diameter portion 37 has a reduced diameter through which a pin portion preceding the flange 10 of the contact pin 1 passes.

Figure 25:
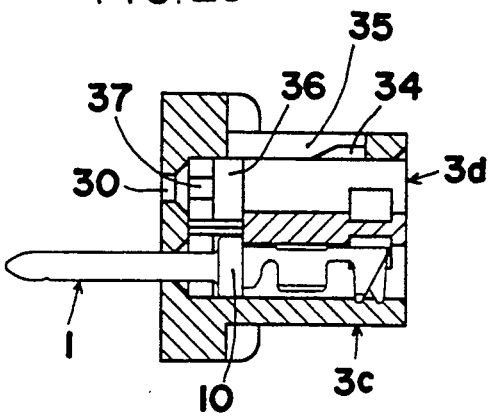
FIG. 25 is a vertical side view of the core fitted into the main body of the pole holding member.
Figure 24:
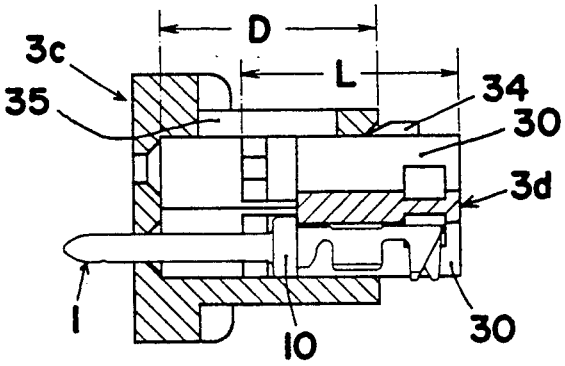
FIG. 24 is a vertical side view of the core in the course of being fitted into the main body of the pole holding member.
Figure 28:
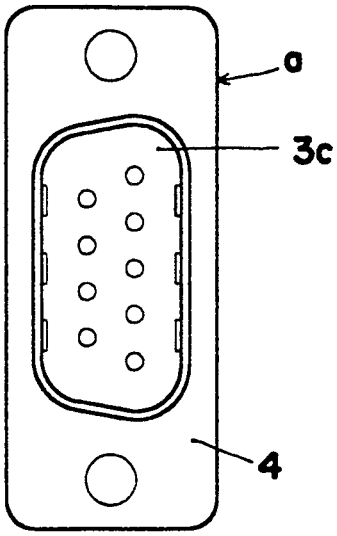
FIG. 28 is a front view of a connector body assembled by providing a shell for an outer periphery of the pole holding member which is assembled by fitting a core into a main body.

The core 3*d* is provided in such a form that the outer periphery of the core 3*d* can be closely fitted into the inner space of the cylindrical portion of the main body 3*c*. As shown in FIG. 24, the core 3*d* includes a longitudinal length L corresponding to a depth D of the cylindrical portion of the main body 3*c*. Accordingly, the core 3*d* can be interposed in the main body 3*c* without an excess or a shortage in longitudinal length when the core 3*d* is inserted into the inner space of the main body 3*c* as shown in FIG. 25.

A description will be given of an operation of the embodiment of the apparatus constructed as set forth hereinbefore.

When the contact pin 1 is held by the pole holding member 3, the core wire 21 of the cord 2 with the contact pin 1 is connected to the connecting portion on the side of a main terminal. The contact pin 1 is arranged in parallel with the pole piece holding hole 30 including the cleavage portion longitudinally extending in the outer periphery of the core 3*d*. In this condition, the flange 10 of the contact pin 1 is inserted into the engaging groove portion 36. The pin portion disposed at the end preceding the flange 10 is positioned to pass through the reduced diameter portion 37. Thereafter, the contact pin 1 is inserted into the pole piece holding hole 30 from a side surface thereof using the cleaved opening portion thereof.

Figure 23:
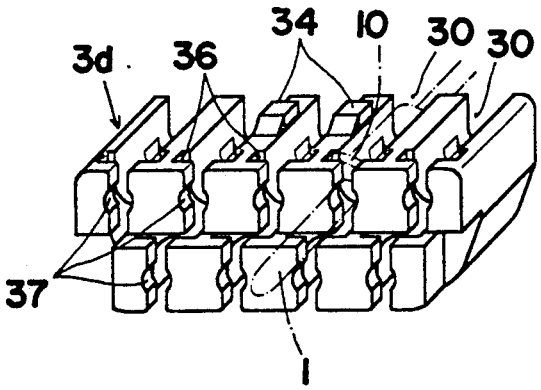
FIG. 23 is a perspective view of the core.

Therefore, the contact pin 1 is fitted into the pole piece holding hole 30 which is provided in the outer periphery of the core 3*d*, and is held as shown by the chain line in FIG. 23. Similarly, the contact pin 1 can be inserted into the pole piece holding hole 30 from the side surface thereof one by one. Consequently, it is very easy to accomplish an operation in which each contact pin 1 is fitted into and held by the pole piece holding hole 30 aligned in the outer periphery of the core 3*d*. Wall portions positioned between the aligned pole piece holding holes 30 are made of synthetic resin having an elasticity. If the contact pin 1 is slightly rigidly fitted into the pole piece holding hole 30, the wall portions can rigidly clamp the contact pins 1 which are fitted into the adjacent pole piece holding holes 30, according to sequential insertions of the contact pins 1. As a result, the contact pins 1 can be rigidly held.

After all the contact pins 1 have been fitted and held, the core 3*d* is inserted into the inner space of the cylindrical portion of the main body 3c. In addition, each pin portion at each pointed end of the held contact pin 1 passes through the circular pole piece holding hole 30 with a small diameter. The pole piece holding hole 30 is disposed in the end wall 33 on the front side of the main body 3c. The pin portion forwardly projects out of the front side of the main body 3c. Thus, it is possible to assemble the pole holding member 3 holding a number of contact pins 1 at the predetermined position.

Figure 26:
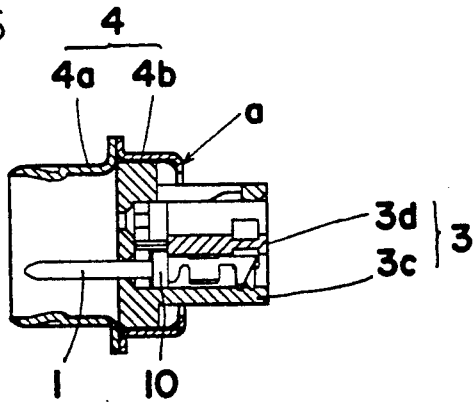
FIG. 26 is a vertical side view of the core fitted into the main body, further provided with the shells.
Figure 29:
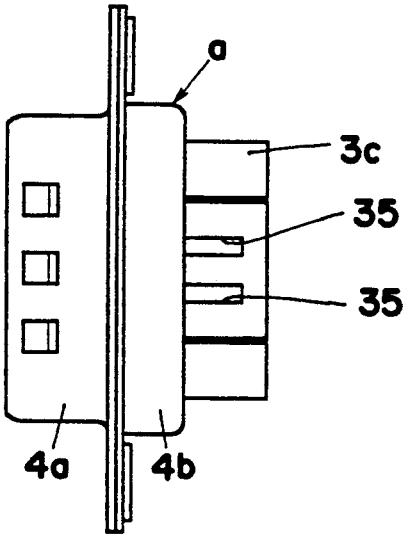
FIG. 29 is a plan view of the connector body.
Figure 27:
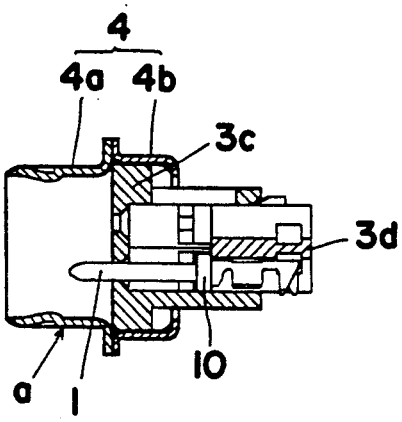
FIG. 27 is a vertical side view of the core in the course of being fitted into the main body provided with the shells in advance.
Figure 30:
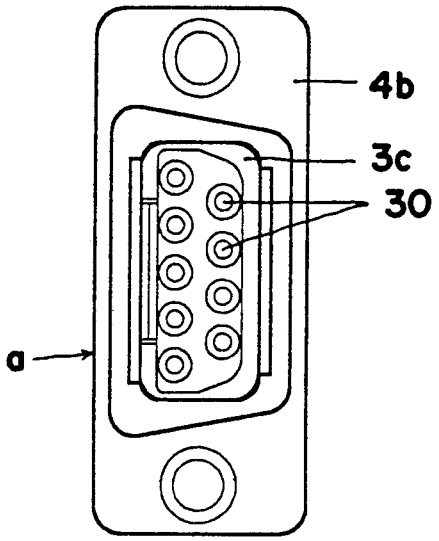
FIG. 30 is a back view of the connector body in advance of fitting a core.
Figure 31:
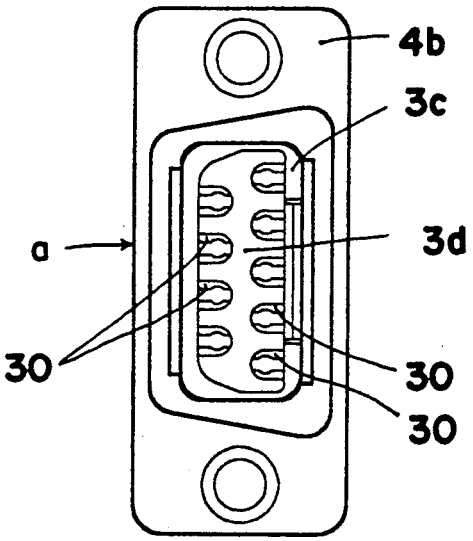
FIG. 31 is a back view of the connector body with the core fitted.
Figure 33:
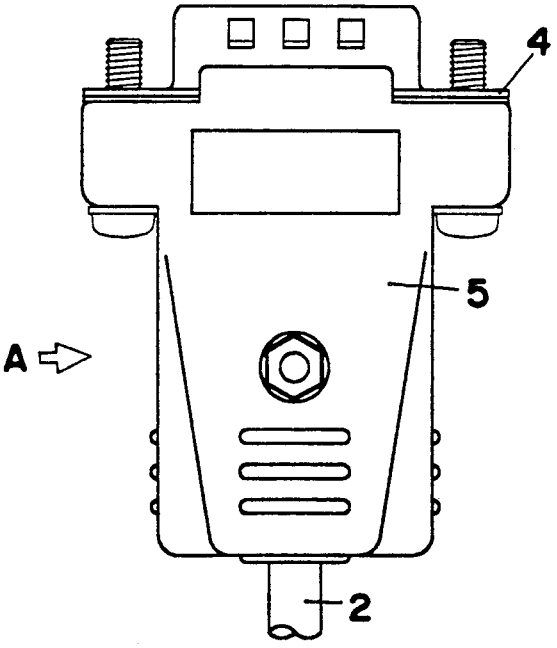
FIG. 33 is a plan view of another embodiment of a connector according to the present invention.
Figure 34:
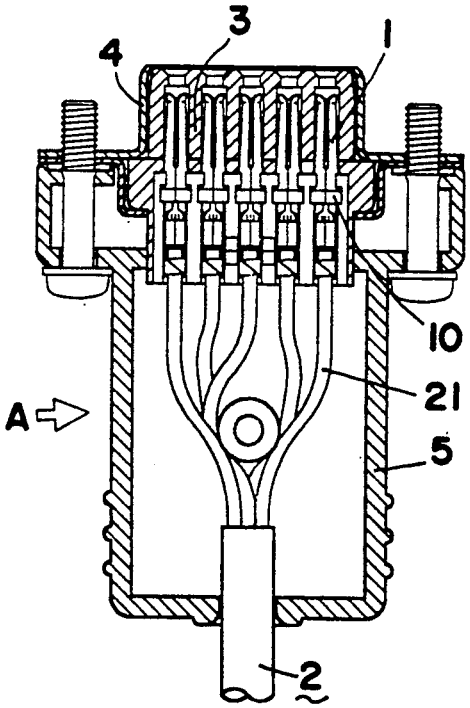
FIG. 34 is a horizontal plan view of the connector.
Figure 32:
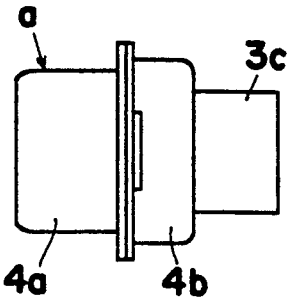
FIG. 32 is a side view of the connector body.
Figure 35:
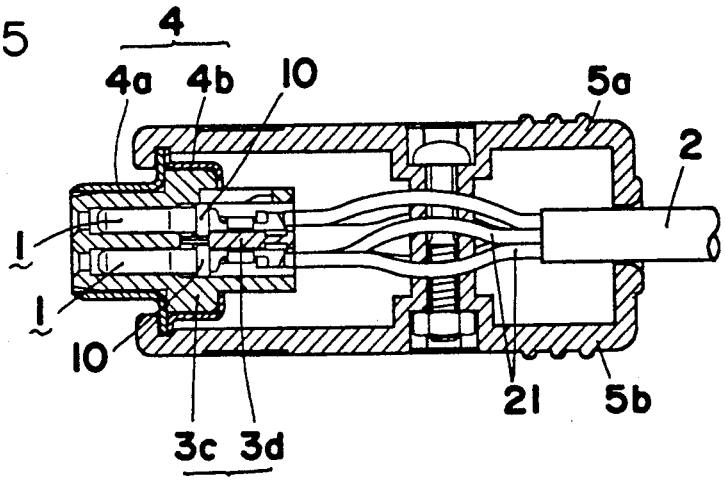
FIG. 35 is a vertical side view of the connector.
Figure 36:
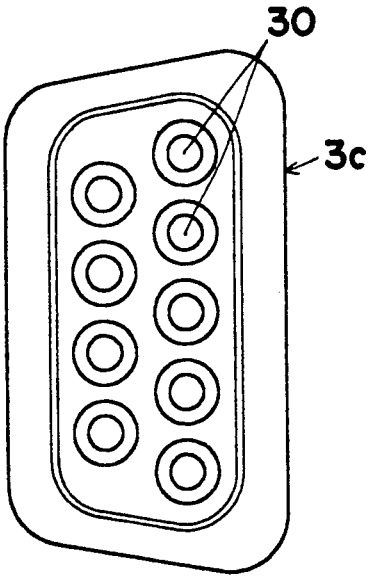
FIG. 36 is a front view of a main body of a pole holding member of the connector.
Figure 37:
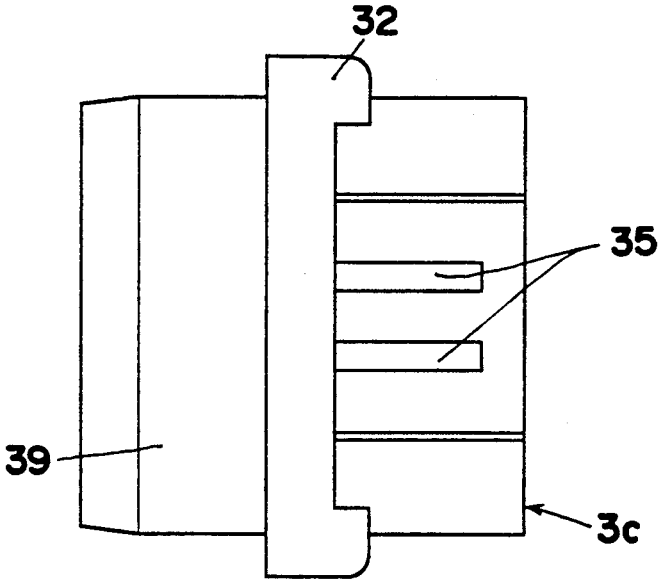
FIG. 37 is a plan view of the main body.

As shown in FIGS. 26 and 27, the pole holding member 3 in the above condition is covered with the front shell 4a and the rear shell 4b. Accordingly, a connector body a can be assembled as shown in FIGS. 28 to 32. A connector A can be assembled by further providing the connector body with the cover 5.

Alternatively, in order to fit the core 3d into the main body 3c, the main body 3c may be enclosed with the front shell 4a and the rear shell 4b in advance. The core 3d holding the contact pin 1 may be then fitted into the main body 3c as shown in FIG. 27.

Another embodiment is illustrated in FIGS. 33 to 56.

In the embodiment, a contact pin 1 includes a sheath type pin, i.e., a female pin instead of a male pin.

Figure 38:
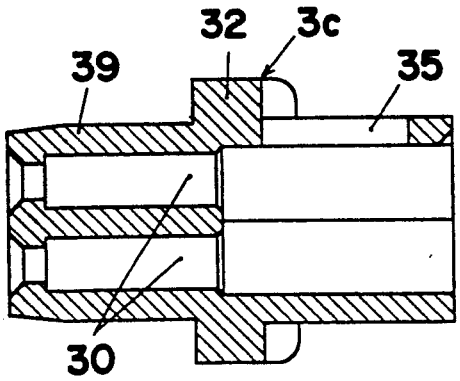
FIG. 38 is a vertical side view of the main body.
Figure 39:
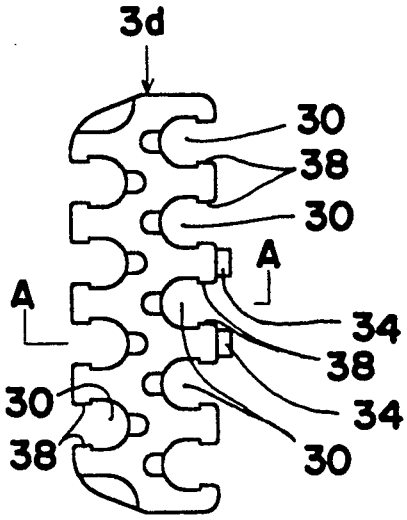
FIG. 39 is a front view of a core fitted into the main body.
Figure 40:
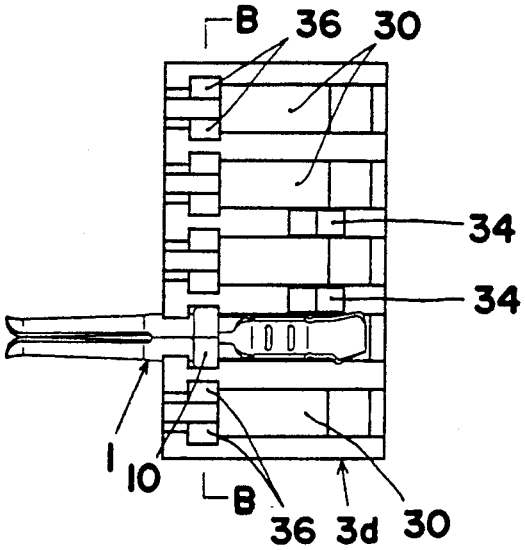
FIG. 40 is a plan view of the core.
Figure 42:
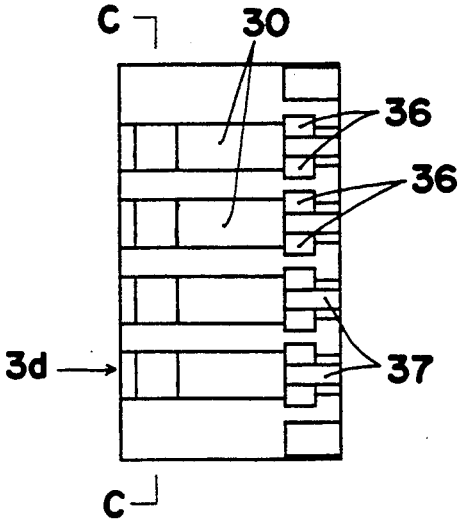
FIG. 42 is a bottom view of the core.
Figure 45:
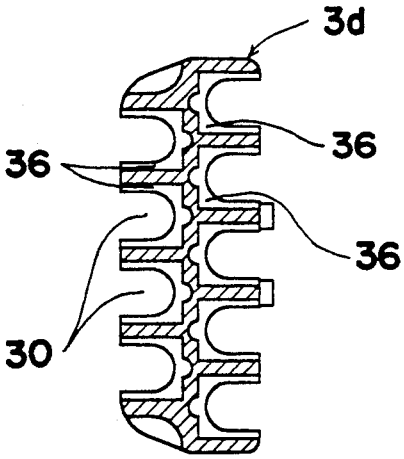
FIG. 45 is a sectional view taken along line B—B of FIG. 40, illustrating the core.
Figure 44:
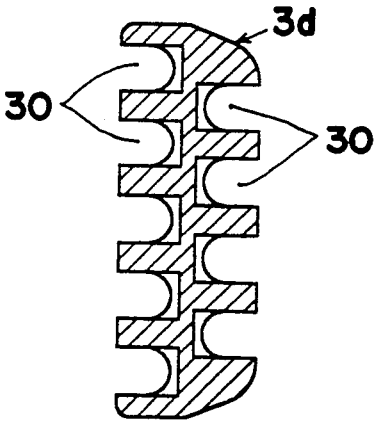
FIG. 44 is a sectional view taken along line C—C of FIG. 42, illustrating the core.
Figure 43:
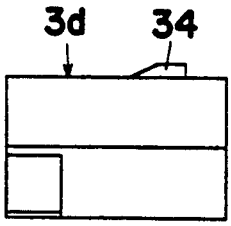
FIG. 43 is a side view of the core.
Figure 41:
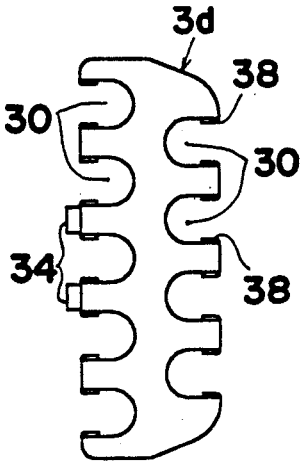
FIG. 41 is a back view of the core.
Figure 46:
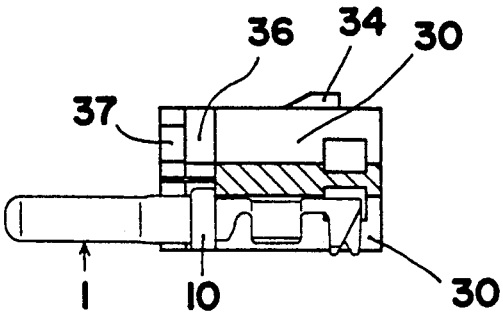
FIG. 46 is a sectional view taken along line A—A of FIG. 39, illustrating the core.
Figure 47:
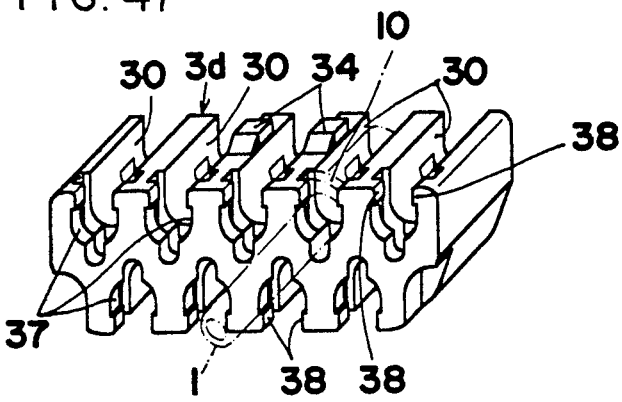
FIG. 47 is a perspective view of the core.
Figure 50:
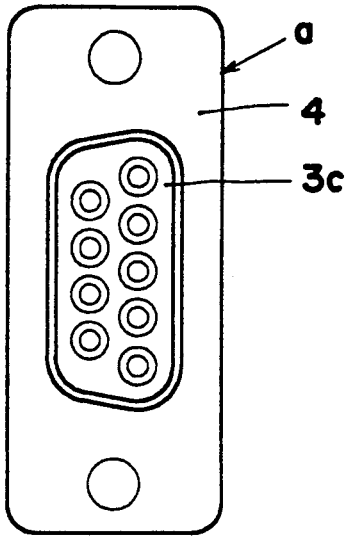
FIG. 50 is a front view of a connector body assembled by providing a shell for an outer periphery of a main body of a pole holding member.
Figure 48:
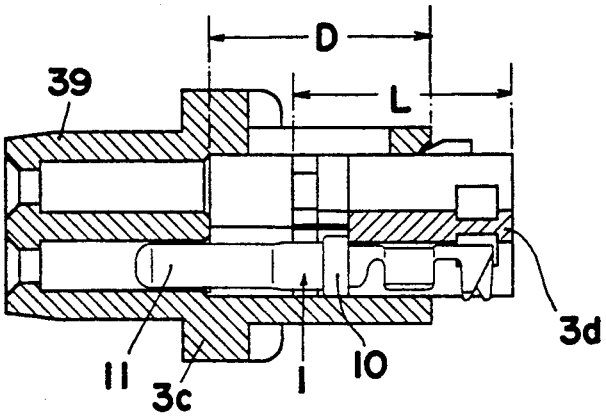
FIG. 48 is a vertical side view of the core in the course of being fitted into a main body.
Figure 51:
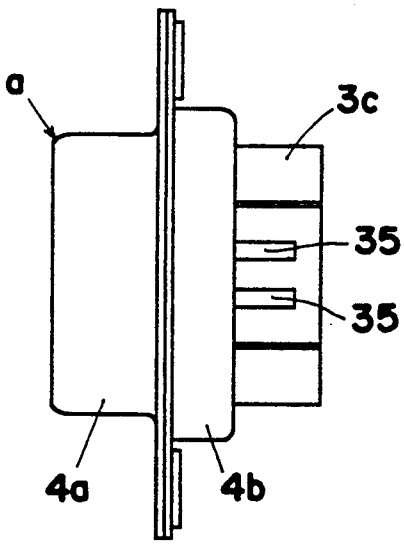
FIG. 51 is a plan view of the connector body.
Figure 49:
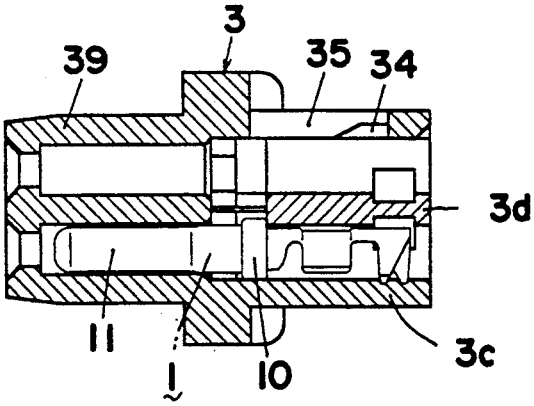
FIG. 49 is a vertical side view of the core fitted into the main body.
Figure 54:
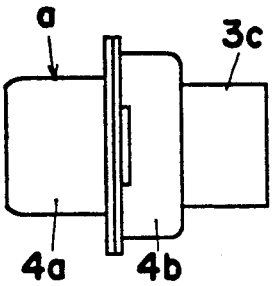
FIG. 54 is a side view of the connector body.
Figure 56:
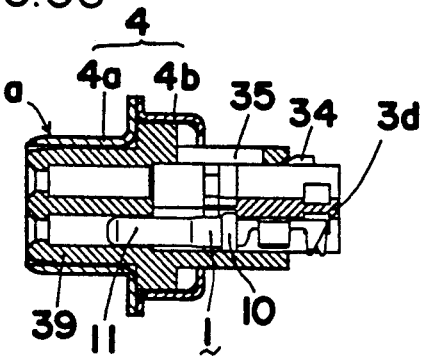
FIG. 56 is a vertical side view of the connector body with a core being fitted into the connector body.
Figure 52:
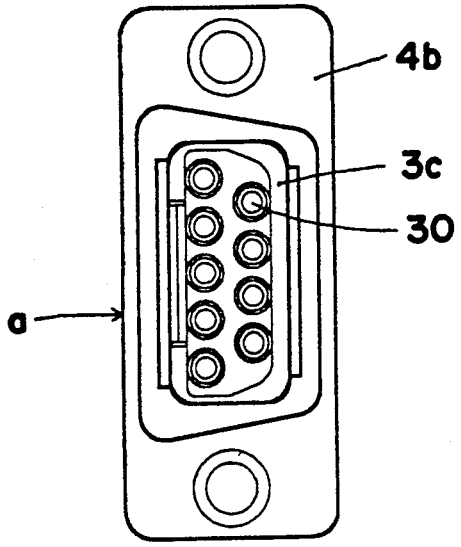
FIG. 52 is a back view of the connector body.

This embodiment differs from the embodiment set forth above in the following structure. According to this embodiment, a projection 38 to avoid passing through is provided on an outer periphery of a core 3d of a pole piece holding member 3. The projection 38 serves to prevent an end portion preceding a flange 10 of a fitted contact pin 1 from forwardly passing out of a pole piece holding hole 30. The pole piece holding hole 30 is provided as a fitting groove with a substantially U-shaped section including a cleavage portion in a side surface thereof. As shown in FIGS. 38 and 49, the main body 3c of the pole holding member 3 is provided with a guide cylinder 39 to surround an outer periphery of a sheath portion 11. The sheath portion 11 is disposed at a pointed end of the contact pin 1 held by the core 3d. Other structures and reference numerals remain identical to those shown in the embodiment set forth above. Therefore, the same reference numerals are used for similar components, and a detailed description of similar structure is omitted.

In this embodiment, the same operation can be provided as in the case of the embodiment set forth above.

Figure 57:
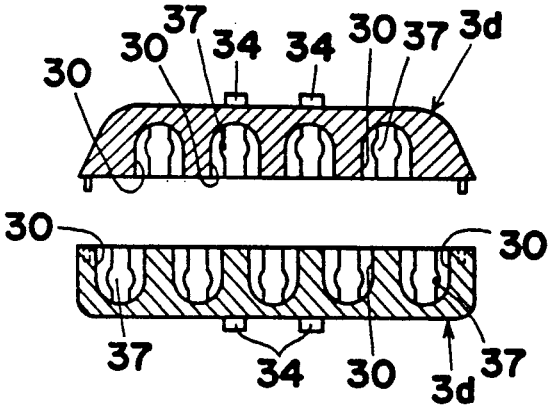
FIG. 57 is a vertical front view of a further embodiment of cores.
Figure 53:
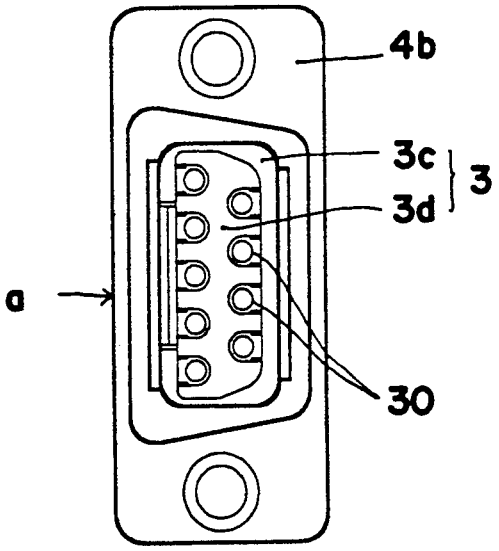
FIG. 53 is a back view of the connector body with a core fitted into a main body of a pole holding member.
Figure 58:
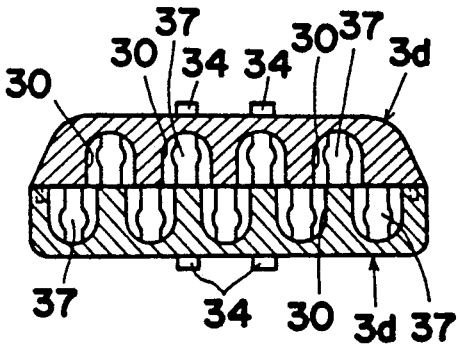
FIG. 58 is a vertical front view of the cores coupled with each other.
Figure 55:
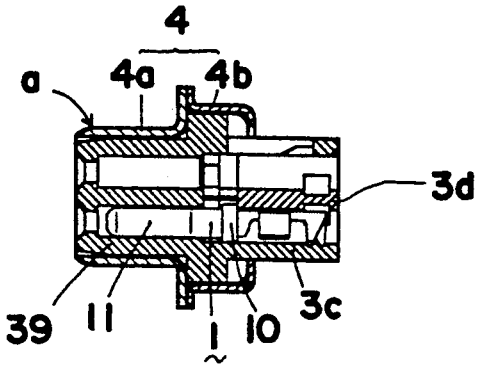
FIG. 55 is a vertical side view of the connector body.

Referring now to FIGS. 57 and 58, further embodiment is illustrated.

In the embodiment, a core 3d is fitted into an inner space of a cylindrical portion of a main body 3c of a pole holding member 3. A pole piece holding hole 30 to hold a contact pin 1 is provided in the core 3d in the form of a fitting groove with a U-shaped section. The pole piece holding hole 30 includes a cleavage portion opening on the side of an outer periphery of the core 3d as in the case of each embodiment set forth above. However, in the embodiment, the pole piece holding holes 30 are provided in the form of the fitting grooves with the U-shaped sections, and are laterally aligned only in one of upper and lower surfaces of the core 3d. Additionally, a pair of cores 3d are coupled such that each surface having the pole piece holding holes 30 are opposed with each other. Each core 3d is coupled to form a single core 3d as shown in FIG. 58. The resulting core 3d is fitted into the cylindrical portion of the main body 3c of the pole holding member 3c as in the case of each embodiment set forth hereinbefore. Other structures of the core 3d remain identical to those shown in the above embodiments.

In this embodiment, the contact pin 1 is similarly fitted into the pole piece holding hole 30 of the pole holding member 3. Namely, the contact pin 1 is arranged in parallel with the pole piece holding hole 30, and is inserted into the pole piece holding hole 30 from a side surface thereof. Thus, the same operation can be provided as in the case of each embodiment set forth hereinbefore.

As noted above, in the pole holding member 3 in a connector according to the present invention, when the contact pin 1 is fitted into and held by the pole piece holding hole 30, the contact pin 1 is arranged in parallel with the pole piece holding hole 30. In this condition, the contact pin 1 can be fitted into the pole piece holding hole 30 from the side surface thereof by moving the contact pin 1 in the direction perpendicular to an axis. As a result, it is possible to facilitate an operation for fitting the contact pin 1 to be held to great extent.

What is claimed is:

1. A pole holding member in a connector comprising:

a main body made of synthetic resin in the form of a cylinder having a bottom;

a core fitted into an inner space of said main body;

said core including a pole piece holding hole to hold a contact pin, which is provided in the form of a fitting groove with a U-shaped section including a lateral cleavage portion opening on the side of an outer periphery of said core; and a bottom wall portion of said main body including said pole piece holding hole through which a pointed end of said contact pin passes.

2. A pole holding member in a connector according to claim 1, further comprising a guide cylinder portion mounted on a front side of a bottom wall portion of a main body to surround a sheath portion which is disposed at said pointed end of said contact pin.

3. A pole holding member in a connector according to claim 1, wherein a core includes a pole piece holding hole provided in the form of a fitting groove with a U-shaped section in one of the outer peripheries of said core, a pair of said cores being coupled in condition where each surface having said pole piece holding hole is opposed with each other, and said pair of cores are fitted into an inner space of a cylindrical portion of a main body.

4. A pole holding member in a connector according to claim 1, wherein an engaging groove is provided in a peripheral wall of a cylindrical portion of a main body, and an anchoring projection (34) being provided on the outer periphery of a core to be fitted into said engaging groove.

* * * * *